US006350504B1

(12) United States Patent
Alboom et al.

(10) Patent No.: US 6,350,504 B1
(45) Date of Patent: Feb. 26, 2002

(54) PRINTED FLOCKED PILE FABRIC AND METHOD FOR MAKING SAME

(75) Inventors: Carlos V. Alboom, Dendeldonk (BE); James R. McCulloch, Providence, RI (US)

(73) Assignee: Microfibres, Inc., Pawtucket, RI (US)

( * ) Notice: Subject to any disclaimer, the term of this patent is extended or adjusted under 35 U.S.C. 154(b) by 0 days.

(21) Appl. No.: 09/089,981

(22) Filed: Jun. 3, 1998

Related U.S. Application Data

(63) Continuation of application No. 08/626,396, filed on Apr. 2, 1996, now abandoned.

(51) Int. Cl.[7] ..... B32B 33/00; D06C 23/00; D06C 29/00

(52) U.S. Cl. ..... 428/88; 428/89; 428/90; 28/160; 28/159; 26/2 R

(58) Field of Search ..... 428/88, 90, 89; 28/159, 160–162; 8/137, 147; 26/2 R

(56) References Cited

U.S. PATENT DOCUMENTS

| | | | | | |
|---|---|---|---|---|---|
| 2,231,995 | A | | 2/1941 | Glidden et al. | |
| 2,376,922 | A | * | 5/1945 | King | |
| 2,881,087 | A | * | 4/1959 | Schwartz et al. | |
| 3,010,179 | A | | 11/1961 | Thal | |
| 3,496,054 | A | | 2/1970 | Baigas, Jr. | |
| 3,698,357 | A | * | 10/1972 | Spencer | |
| 3,917,883 | A | * | 11/1975 | Jepson | 427/198 |
| 3,944,693 | A | * | 3/1976 | Ungerer | |
| 3,961,115 | A | * | 6/1976 | Klein | 428/88 |
| 3,989,453 | A | * | 11/1976 | Jilla | 8/66 |
| 4,091,764 | A | * | 5/1978 | Brennenstuhl | |
| 4,147,813 | A | * | 4/1979 | Casey | 427/27 |
| 4,259,853 | A | * | 4/1981 | Fleissner | |
| 4,294,577 | A | * | 10/1981 | Bernard | 8/488 |
| 4,438,533 | A | * | 3/1984 | Hefele | |
| 4,497,095 | A | | 2/1985 | Minemura et al. | |
| 5,059,452 | A | * | 10/1991 | Squires | 428/90 |
| 5,108,777 | A | * | 4/1992 | Laird | |
| 5,400,485 | A | * | 3/1995 | Bialostozky-Krichevsky | 28/163 |
| 5,543,195 | A | * | 8/1996 | Squires et al. | 428/90 |
| 5,756,180 | A | | 5/1998 | Squires et al. | |
| 5,863,633 | A | | 1/1999 | Squires et al. | |

FOREIGN PATENT DOCUMENTS

| | | | |
|---|---|---|---|
| EP | 0 581 614 A | * | 2/1994 |
| EP | 581 614 | * | 2/1994 |
| GB | 1 431 958 | * | 4/1976 |
| WO | WO 96 29462 A | * | 9/1996 |

* cited by examiner

*Primary Examiner*—Cheryl A. Juska
(74) *Attorney, Agent, or Firm*—Wolf, Greenfield & Sacks, P.C.

(57) ABSTRACT

A printed multicolor synthetic pile fabric having a substrate and pile formed of fibers of substantially uniform length and diameter with the fibers arranged in random groups extending uniformly across the entire width and along the entire length of the fabric. Each group comprises a random number of fibers extending at an angle and in a direction that randomly varies from the angles and directions of the fibers in adjacent groups. The fibers within each group are preferably set in the greige goods.

13 Claims, 1 Drawing Sheet

PRINTED FLOCKED PILE FABRIC AND METHOD FOR MAKING SAME

RELATED APPLICATIONS

This application is a continuation of application Ser. No. 08/626,396 entitled: IMPROVED PRINTED PILE FABRIC AND METHOD FOR MAKING SAME, filed Apr. 2, 1996, and now abandoned.

FIELD OF INVENTION

The present invention relates to an improved printed flocked pile fabric and method for making the same.

BACKGROUND OF INVENTION

Conventionally made printed flock fabrics involve a process in which the fabric, comprising a flocked coated substrate, is printed utilizing screen printing techniques. Thereafter, the pile is steamed, washed, and properly finished. These products generally result in a fabric having a pile surface of uniform texture, in which the individual fibers are uniformly oriented. Such fabrics have no textured surfaces and rely primarily on the pattern that is imprinted to provide the fabric with its desired characteristics.

Additionally, pile fabrics have been made with textured surfaces. Insofar as the Applicant is aware, however, the textured surfaces herein described have not been fabricated in a multicolor flocked pile fabric in which greige goods are formed with the pile fibers arranged in random groups, extending uniformly across the width and along the length of the fabric, as a result of a specific sequence of steps, including the washing of the greige goods prior to printing.

In the prior art of fabricating multicolored printed flocked pile fabric with a uniform non-textured surface, occasional rejects occur when small numbers of the fibers forming the pile are misoriented from the desired lay of the pile. These rejects or seconds usually result in an imperfect fabric having occasional creases or misdirected groups of fibers that mar and distort the uniform surface of the fabric. The source of the occasional random orientation of the fibers in these sections arises from a variety of processing problems. Heretofore, these random arrays of discrete misoriented fibers have been uniformly considered unacceptable. It has therefore been conventional to attempt to eliminate this non-uniform appearance of printed flocked fibers.

In addition to occasional random appearances of discrete misoriented fibers in multicolored flocked fabrics, uniformly dyed pile fabrics have also been made of natural woven fibers, such as cotton or viscose. In such woven systems, cotton or viscose pile fabrics are conventionally dyed. After dyeing, fabrics can be printed using conventional print techniques such as pigment printing or discharge printing.

Flocked fabrics have also been piece dyed. In these products, the fabric is dyed with a single color by conventional dyeing techniques. It is during the dyeing process that the fabric is formed with its randomly arranged fibers. Because the fibers are dyed at temperatures in the order of 90° C. (i.e., 194° F.) that are necessary to set the dyes, the resultant product does not lend itself to subsequent color treatment. In particular, the fabric has a solid ground which cannot be further processed with resist printing. If dyed flocked fabrics were subsequently printed with pigment or direct prints, the range of multicolor possibilities would be severely limited by this process.

Texturing has also been attempted by air embossing flocked fabrics and, thereafter, printing. Additionally, heat embossing greige goods and thereafter imprinting them have also been attempted. These systems, however, have certain limitations with respect to the appearance, softness of pile, and styling.

Individual steps that are useful in practicing the present invention have also been well known in the fabric trade. This includes, for example, such practices as open width washing, in which greige goods are washed in an open width or, alternately, in a Beck machine prior to printing. The purpose of such washing steps, however, is to prepare the pile fabric by assuring the directional lay of the pile or, alternately, for providing a light scouring for purposes of improving color adherence or for creating a uniform surface of the pile in one direction. Printed flocked fabrics have been washed in commercial jet or bleach machines after printing. However, it is not economically feasible to obtain a random textured effect in this manner.

Heretofore, the processes that have been commercially available have not been useful in creating a printed pile fabric in which the surface texture of the pile is random or textured.

SUMMARY OF INVENTION

The present invention provides a method of fabricating a multicolor printed flocked pile fabric having a non-uniform or textured pile surface, in which the fibers forming the piles are oriented in small groups in various directions across the entire width and along the entire length of the fabric to provide a distorted or casual surface appearance, unlike the conventional velvet-like surface appearance of ordinary pile fabrics.

In the present invention, there is provided an improved method for fabricating a printed pile flocked fabric having fibers arranged in small groups, randomly oriented, over the entire length and width of the fabric, with these fibers providing a textured surface of random or distorted appearance.

A further object of the present invention is to provide an improved and different printed pile fabric having more volume, a softer hand, and a gentler crush effect than fabrics heretofore made using conventional techniques.

A further object of the present invention is to provide an improved method of making printed flock fabrics having textured surfaces.

BRIEF DESCRIPTION OF THE DRAWINGS

The foregoing objects and advantages of the present invention will be more clearly understood when considered in conjunction with the accompanying drawings, in which.

DESCRIPTION OF PREFERRED EMBODIMENT

Figure 1:
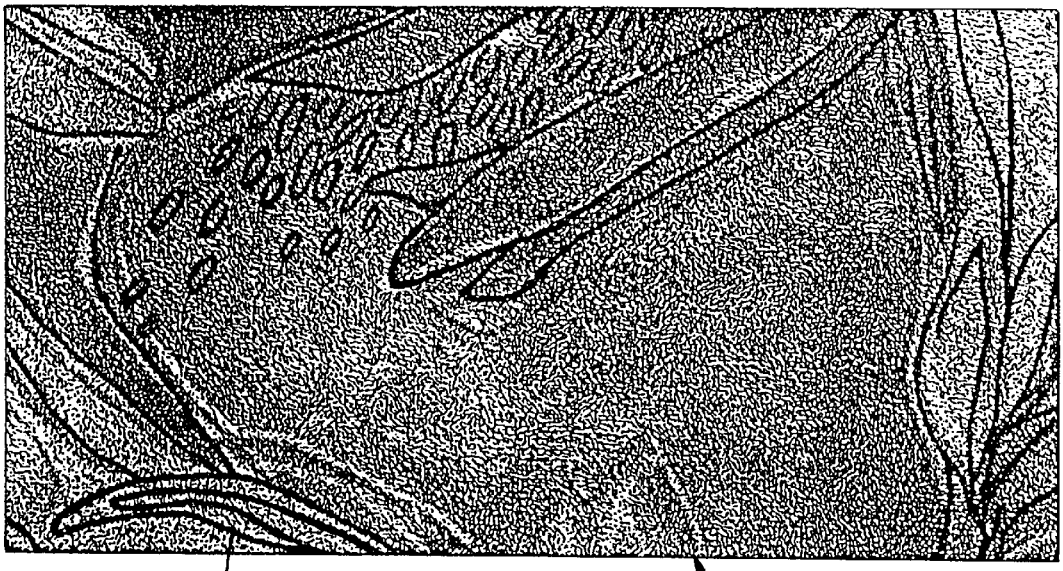
FIG. 1 is a top plan view of a segment of fabric made in accordance with the present invention.

In a conventionally formed multicolor flocked printed pile fabric, the surface of the pile is uniform and smooth and has no effective textured appearance, because the individual fibers forming the pile are secured to the substrate at substantially parallel angles to one another. In the fabric made in accordance with the present invention, the fabric 10 is formed with a substrate 11 and flocking comprising fibers 14 secured to the substrate conventionally by a layer of adhesive 16. The fiber size, shape, and weight may vary depending upon the specific application desired. The fibers may be dyed or not dyed. Typically, in the present invention, however, the individual fibers are formed in groups 18, 20, 22, etc. of random size and shape over the entire width and length of the fabric, with the individual fibers within each group oriented in directions angular to one another. Thus, for example, one group may be at an angle of 70° from the substrate and extend in one direction, while an adjacent group may have the fibers at an angle of 85° from the substrate and extend in a direction normal to this direction of the fibers of the first group. These groups 18, 20, 22, etc. have tuft-like appearances that extend across the entire surface of the fabric 10, forming a surface of non-uniform appearance, as best illustrated at 10. This non-uniform appearance exists irrespective of the print or color design selected for the fabric. In this case, the multicolor print design includes, for example, a series of line designs 30.

In viewing the embodiment of FIG. 1, the textured nature of the fabric may be noted from the spacing visibly noticeable between groups that results from the random variation in angles and directions of the fibers within the groups. These spaces 42 have essentially hairline appearances, for example, as illustrated at 40 and 41 in FIG. 2. Because the angles of the fibers to the substrate vary, the upper surface of the fabric is non-uniform, as illustrated by comparing the relative heights of groups 18 and 20.

Figure 3:
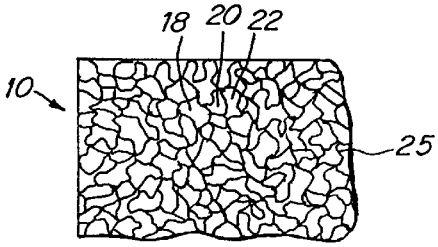
FIG. 3 is a schematic fragmentary plan view of a segment of fabric made in accordance with the present invention, without the print illustrated.
Figure 4:
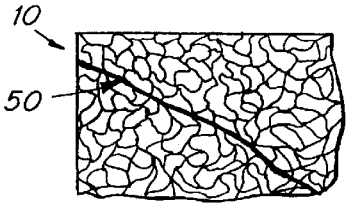
FIG. 4 is a schematic plan view similar to FIG. 3, illustrating a defective fabric segment.

The nature of the invention may also be understood from consideration of FIGS. 3 and 4. Here there is illustrated schematically a corner piece of fabric with the groups 18, 20, and 22. As illustrated, each group has a random shape and size that is defined by the different orientations of fibers from group to group. The defining borders of a group have a visual appearance of a fine line into the naked eye, as illustrated at 25. This fine line is formed by spacing 42 in the embodiment illustrated, comprised of very short, erratically directed segments. However, if the fabric is processed in a manner outside the heating cycles described, the fibers may occasionally orient along very long lines. Such lines have the appearance of unwanted creases 50 and should, in the embodiment described, be avoided. However, there may be occasions in which a fabric is formed intentionally with lines similar to line 50. If so, however, such lines should appear sufficiently frequently across the width and along the length of the fabric to create an appearance that the crease is a desire component of the pattern, much like the long lines that frequently appear in leather.

The spaces between groups illustrated in FIG. 1 have a hairline appearance and, in the embodiment of the invention illustrated, the groups have relatively small shapes defined by sides that are of in the order of 1/16" to ½" in length. These lines, defining one group from the other, may be varied in length and, to some extent, in width, by varying the parameters of the process hereafter described. The hairlines illustrated at 40 and 41 may, for example, be much longer in length than those heretofore described, by suitable variations in the parameters of the application and may, in fact, take on the appearance of creases, with the creases extending into the adhesive layer 16 or substrate 11. However, in forming a fabric of this type with longer lines, it is important that the fabric have a substantially uniform appearance over its entire length and width. In short, an occasional line clearly defined, for example, two or three inches long or more, appearing at a foot or two or three apart in the fabric, otherwise formed with creases or lines illustrated in FIG. 1, would not be desirable. The fabric should have uniformity throughout its surface to achieve the desired textured effect. These aberrant lines may be avoided by proper control of the parameters of the process.

Figure 2:
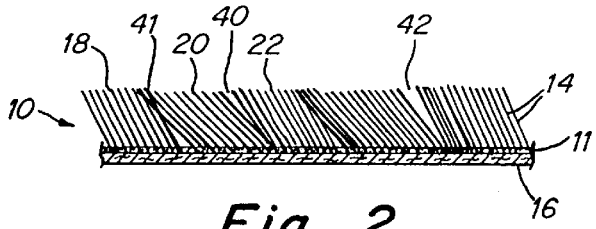
FIG. 2 is a schematic cross section of a fabric made in accordance with this invention.

The fabric illustrated in FIGS. 1 and 2 is formed by first subjecting the flocked substrate or greige goods to a batch washing cycle, prior to printing, in which the wash cycle is designed to create a non-uniform, random laydown of the fibers over the entire fabric being treated, which achieves the desired textured or distorted appearance. As used herein, greige goods include fabric having either dyed or undyed flocked fibers. In this process, selected flocked greige goods are prepared for washing. These flocked greige goods may vary, depending upon the particular end product desired, but typically, and for example, may comprise a poly-cotton woven Osnaburg, an acrylic adhesive layer and a flocked pile of polyamide fibers. The substrate, typically, may have a 3.4-ounce-per-square-yard weight, while the fibers, having cut lengths of 0.045" to 0.050", with a denier of 1.7 and a weight of 2 oz per square yard, are secured to the substrate by a suitable acrylic adhesive which may, for example, weigh 2.3 oz. per square yard. Other possible substrate fiber combinations may be selected, depending upon the particular purposes desired.

The greige goods are preferably cut into uniform lengths for batch processing. Thus, for example, eight lengths of greige goods are each formed into tubes by tacking or basting stitches along the length of the fabric to form elongated tubes. For the particular example set forth, the fabric tube would preferably be in the order of 200 meters in length. The tubes are tacked, preferably with the pile on the inside, although, in alternate processes, arranging the piles on the outside or even processing the fabric in non-tubular form is contemplated. However, the tubular forms are preferred.

After the greige good fabrics are formed into the tubes, they are loaded into a jet-dyeing machine for further processing. The machine should be fully loaded. Alternately, a Beck dyeing machine may be used, or even a continuous washing range. Liquor is added to the machine, with a liquor/fabric ratio of 1:10, although a range of 1:5 to 1:15 is possible. The liquor is formed by the sequential addition of water at 30° C. Thereafter, a fabric softener may be added. The fabric softener may be a commercially available one, sold under the mark CIBA FLUID-U. Preferably, 1 cc per liter of water is added. After the liquor and fabric have been loaded into the machine, a non-ionic washing agent may be added, depending upon the particular fiber that comprises the fabric. The purpose of the non-ionic washing agent is to remove spin oils; preferably approximately 1 cc per liter of water is added. After the fabric and liquor are in the machine, the temperature of the liquor is raised to 40° C. It is preferable to maintain the temperature at at least 40° C. in order to minimize the creasing that might otherwise occur in the washing cycle. The fabric is washed for 30 minutes, while the temperature is maintained at preferably at least 40° C. After this washing or scouring, the liquor is removed, and the dyeing machine is refilled. The liquor is warmed to 80° C. Preferably, a desizing agent is added. Ordinarily no more than 2 grams are needed. The purpose of the desizing agent is to take off the starch from the substrate, which further assists in minimizing the likelihood of creases forming and softens the overall fabric. The fabric is then again washed, with the temperature maintained at 80° C. Following this second wash, the dyeing machine is emptied of the liquor and refilled once again with water at 30° C. After the water is introduced at 30° C., it is raised to 70° C. and the fabric again rinsed for 15 minutes at 70° C. The water is then removed and the dyeing machine once again refilled with water at a temperature of in the order of 30° C. and rinsed for a further 10 minutes. The water is again removed and the fabric placed in a suitable centrifugal extraction machine, where the water is extracted for in the order of 15 minutes. During the extracting cycle, the fabric will ordinarily remain in its tacked, tubular condition. Drying continues until about 75% of the water has been removed.

Following the removal of the water on the centrifugal extraction machine, the fabric is then opened by removing the basting stitches, and the fabric is flat folded.

The fabric is thereafter dried on a Tenter frame under an air flow which is slow enough so that the pile is not disturbed. Typically, the drying may take place with an airflow ventilator fan rotating at 3,000 RPM over the fabric in which the Tenter frame is moving at a rate of in the order of 20 meters per minute and at a temperature of in the order of 160° C. for a period of in the order of one minute. The fabric is thereafter wound up on an A frame in a manner so as to avoid unnecessary crushing or compression of the pile fibers. The wind-up tension of the A frame should also be selected to permit the pile to remain erect and present a consistent surface texture of the winding from one end to the other. Alternately, the fabric may be flat folded.

The temperature parameters selected for washing and treating the fabric prior to conventional screen printing set forth in the above exemplifications are intended to suggest a temperature in which re-orientation of the pile fibers in the random array described is effected. Typical temperatures which may be used range from between 20° C. and 90° C., as well as a dwell time of 1–4 hours. The particular size, the arrangement of the various groups, and the defined lines may be varied from very fine to very long or narrow to wider, depending upon the particular parameters selected. It should be recognized that when pile fabric is subject to a wet printing process, pile, as for example nylon flocked pile, is heat set during the steaming process when subjected to temperatures in excess of about 200° F. For that reason, it must be recognized that once the fabric has been steamed at temperatures in excess of this order of magnitude, the random textured effect cannot be effectively removed unless the fabric is subjected to higher temperatures.

After the fabric has been dried on a Tenter frame, it is then subject to a conventional printing process, in which the fabric is, preferably, printed by screen printing processes, using a series of screens for different colors. Resist, direct, or pigment dyes may be used. Thereafter, the printed fabric is steamed, washed once again, and finished in a conventional fashion. As an alternative to the wet printing process, transfer paper printing may also be used.

As noted previously, the characteristics of the finished product may be changed by varying the cut length or size of the fibers, their shape, or the flock weight. Increasing the fiber length, for example, tends to increase the appearance of a random effect. Similarly, increased flock weight appears to increase the appearance of a random effect.

Having thus described one particular embodiment of the invention, various alterations, modifications, and improvements will readily occur to those skilled in the art. Such alterations, modifications, and improvements are intended to be part of the disclosure and are intended to be within the spirit and scope of the invention. Accordingly, the foregoing description is by way of example only and is not intended as limiting. The invention is limited only as defined in the following claims and the equivalents thereof.

We claim:

1. A printed multicolor synthetic flocked pile fabric comprising a substrate and a pile formed of fibers, with the fibers arranged in random groups extending uniformly across the entire width and along the entire length of the fabric, with each group comprising a random number of fibers extending at angles and in directions that randomly vary from the angles and directions of the fibers in adjacent groups, wherein the fabric is produced by a process comprising the steps of:

subjecting a flocked pile fabric to a liquid at alternately low and high temperatures falling within a range of 20° C. to 90° C. in order to randomly re-orient the fibers forming the pile from a uniform parallel orientation into random groups of fibers with angular and directional orientations that vary from one group to the other; and thereafter drying and printing the substrate with the fibers in said re-oriented position.

2. A printed flocked pile fabric as set forth in claim 1, in which the fabric is a flocked fabric, whereby during the subjecting step the fibers are reset from an array in which the fibers extend in the same direction at essentially the same angle to an array comprising said random groups with said fibers extending from the substrate at angles of substantially 70° or more.

3. A printed pile fabric as set forth in claim 1, wherein the random variation in angles and directions of the fibers within each group define spaces having a hairline appearance on the surfaces which spaces form borders around each of said groups.

4. The printed multicolor synthetic flocked pile fabric as set forth in claim 3, wherein the spaces having a hairline appearance are on the order of 1/16 to ½ inch in length.

5. A fabric as set forth in claim 1 wherein said fabric is multicolored printed with a plurality of screens.

6. A fabric as set forth in claim 1 wherein said fabric is multicolored transfer printed.

7. A fabric as set forth in claim 6 in which said fabric is heat set before printing.

8. A fabric as set forth In claim 1 wherein said flocked fabric is heat embossed prior to the subjecting step.

9. A fabric as set forth in claim 1 wherein said flocked fabric is air embossed prior to the subjecting step.

10. A fabric as set forth in claim 1 wherein the fabric is dyed before printing.

11. A fabric as set forth in claim 1 wherein said fibers are arranged in said random groups when said fabric is in a greige goods stage.

12. A fabric as set forth in claim 11 wherein said fibers in said greige goods stage are dyed.

13. A printed synthetic flocked pile fabric comprising:

a substrate; and a pile formed of fibers, with the fibers arranged in random groups extending uniformly across the entire width and along the entire length of the fabric, with each group comprising a random number of fibers extending at angles and in directions that randomly vary from the angles and directions of the fibers in adjacent groups, with the groups of fibers being defined from one another by visually discernable spaces having a hairline appearance, wherein the fabric is produced by a process comprising the steps of:

subjecting a flocked pile fabric to a liquid at alternately low and high temperatures falling within a range of 20° C. to 90° C. in order to randomly re-orient the fibers forming the pile from a uniform parallel orientation into random groups of fibers with angular and directional orientations that vary from one group to the other; and thereafter drying and printing the substrate with the fibers in said re-oriented position.

* * * * *

UNITED STATES PATENT AND TRADEMARK OFFICE

CERTIFICATE OF CORRECTION

PATENT NO. : 6,350,504 B1 
DATED : February 26, 2002
INVENTOR(S) : Carlos Van Alboom et al.

It is certified that error appears in the above-identified patent and that said Letters Patent is hereby corrected as shown below:

Title page,
Item [75], -- [75] Inventors: Carlos Van Alboom, Dendeldonk (BE); James R. McCulloch, Providence, RI (US) --.

Signed and Sealed this

Eleventh Day of June, 2002

*Attest:*

*Attesting Officer*

JAMES E. ROGAN
*Director of the United States Patent and Trademark Office*